US006230943B1

(12) United States Patent
Miyamoto et al.

(10) Patent No.: US 6,230,943 B1
(45) Date of Patent: May 15, 2001

(54) AEROSOL PRODUCT AND METHOD FOR MANUFACTURING THE SAME

(75) Inventors: Hidetoshi Miyamoto, Toyonaka; Satoshi Mekata, Ibaraki, both of (JP)

(73) Assignee: Osaka Shipbuilding Co., Ltd., Osaka (JP)

( * ) Notice: Subject to any disclaimer, the term of this patent is extended or adjusted under 35 U.S.C. 154(b) by 0 days.

(21) Appl. No.: 09/403,979

(22) PCT Filed: Sep. 30, 1998

(86) PCT No.: PCT/JP98/04392

§ 371 Date: Oct. 29, 1999

§ 102(e) Date: Oct. 29, 1999

(87) PCT Pub. No.: WO99/44916

PCT Pub. Date: Sep. 10, 1999

(30) Foreign Application Priority Data

Mar. 3, 1998 (JP) ..... 10-050533

(51) Int. Cl.[7] ..... B65D 83/14; B65D 83/42; B65D 83/58; B05B 9/04

(52) U.S. Cl. ..... 222/394; 222/386.5; 222/389; 222/402.1; 222/1

(58) Field of Search ..... 222/386.1, 386.5, 222/389, 394, 402.1

(56) References Cited

U.S. PATENT DOCUMENTS

| | | | | |
|---|---|---|---|---|
| 4,202,470 | * | 5/1980 | Fujii | 222/386.5 |
| 5,277,336 | * | 1/1994 | Youel | 222/394 |
| 5,423,454 | * | 6/1995 | Lippmann et al. | 222/1 |
| 5,738,253 | * | 4/1998 | Diamond | 222/389 |
| 6,039,222 | * | 3/2000 | Smith | 222/386 |

FOREIGN PATENT DOCUMENTS

| | | |
|---|---|---|
| 5-254579 | 10/1993 | (JP) . |
| 8-11954 | 1/1996 | (JP) . |
| 9-104487 | 4/1997 | (JP) . |

* cited by examiner

*Primary Examiner*—J. Casimer Jacyna
(74) *Attorney, Agent, or Firm*—Armstrong, Westerman, Hattori, McLeland & Naughton LLP

(57) ABSTRACT

An aerosol product comprising a double-chamber container separated by a movable partition capable of dividing contents therewith, one spatial portion thereof being loaded with contents to be discharged and the other spatial portion being loaded with compressed gas for pressurizing. The compressed gas is a mixed compressed gas of at least two types of mixed gas, at least a part of the partition presents permeability of the compressed gas, and the mixed compressed gas selectively permeates the partition to be dissolved in the contents to be ready for discharge.

8 Claims, 6 Drawing Sheets

AEROSOL PRODUCT AND METHOD FOR MANUFACTURING THE SAME

TECHNICAL FIELD

The present invention relates to an aerosol product. More particularly, the present invention relates to an aerosol product of which internal pressure is made low and which can be easily manufactured, and a method for manufacturing the same. The present invention also relates to an aerosol product wherein a loading amount of contents can be increased than compared to conventional products.

BACKGROUND ART

For spraying contents of an aerosol product in a form of fine foggy particles or discharging contents in a foamed condition, it was conventionally the case that compressed gas such as carbonic acid gas ($CO_2$) was filled into an aerosol container as a propellant to be dissolved within the contents.

For making the compressed gas dissolve within the contents, a specified amount of contents is first loaded into the container and compressed gas is then loaded into the container at a high pressure. Since the compressed gas is dissolved into the concentrate (contents), it is necessary to apply a high pressure exceeding an internal pressure of the final aerosol product in an equilibrium state.

Explanations will now be given based on a case of a general aerosol product containing therein compressed gas having an Ostwald absorption coefficient (hereinafter referred to as simply "Ostwald coefficient") of 1 as well as contents and wherein the volumetric ratio of the contents is approximately 60% and the volumetric ratio of the compressed gas approximately 40% of the total capacity of the container in case an internal pressure within the container is 0.6 MPa (hereinafter all given as gauge pressure).

As referred herein, the Ostwald coefficient simply represents numeric values of a gaseous volume (ml) dissolved in 1 ml of solvent at temperature t° C. in case a partial pressure of the gas is set to 760 mmHg. In case the temperature is identical, the dissolution ratio is proportional to pressure.

Hence, it is necessary to first inject contents into the container corresponding to approximately 60% by volume under atmospheric pressure, followed by injection of compressed gas of 1.5 MPa. A pressure P of gas to be injected and corresponding to 40% by volume based on an equilibrium pressure within the container of 0.6 MPa (40% by volume of compressed gas and 60% by volume of aerosol) is given by the equation $$P\times0.4=0.6\times0.4+(0.6\times0.6)\times1,$$

so that the above value of 1.5 MPa can be obtained. As a general formula, the following equation (1) can be obtained.

$$P_1=P_2\times\{\chi+\beta(1-\chi)/\chi \quad (1)$$

While it is presupposed in this equation that the compressed gas does not dissolve into the contents until the loading of the compressed gas is completed, the compressed gas actually starts to slightly dissolve within the contents during the loading process so that a maximum pressure in the above case is slightly less than 1.5 MPa and approximately 1.4 MPa.

However, conventional aerosol containers can generally not bear even such a degree of pressure. Even if a container should bear this pressure, drawbacks are caused such that a fixing (crimp) of an aerosol valve become loosened. In case of using a container capable of bearing such a high pressure, manufacturing costs will remarkably increase.

Therefore, it is conventionally performed that a separate large sized pressure resistant container is used for the manufacture of aerosol liquid which is sequentially loaded into individual aerosol containers. This method still presents drawbacks in that facilities costs will be largely increased and is also accompanied by increased number of steps during manufacturing.

In a conventional aerosol product using a single-walled can for compressed gas products, the interior pressure of the container gradually decreases each time spraying of the contents is performed. Accompanying this, the amount of dissolved compressed gas is also decreased whereby it becomes difficult to maintain an action of making the foggy particles of the contents fine. Due to this reason, it is required to set the initial pressure as well as the loading rate for the gas high.

In the case a false operation (e.g. the product is used in an inverted posture while the specification prescribes that it should be used in an erected posture), only gas is sprayed so that the pressure of the product is remarkably decreased. It is known for conventional methods for solving this problem wherein a weight is provided at a tip of a tube provided at a valve, while this method is not very reliable due to reasons that the weight might not work in a sufficient manner.

It has then been proposed for an aerosol product with the aim of solving this problem as disclosed in Japanese Unexamined Patent Publication No. 253408/1996 utilizing a double-chamber container including an inner cylinder and an outer cylinder with which it is aimed to restrict decreases in the amount of dissolved compressed gas accompanying the increase in number of spraying.

In this aerosol product utilizing a double-chamber container, the contents are loaded into the interior of the inner cylinder while compressed gas is dissolved into the contents, and a spatial portion between the inner cylinder and the outer cylinder is loaded with compressed gas as a pressurizing agent such as liquefied petroleum gas (LPG) or nitrogen. Since the inner cylinder is a flexible sack-like body made of synthetic resin or the like, the inner cylinder is shrunk by the pressure applied by the pressurizing agent even if the contents included in the inner cylinder is used to be decreased, so that it can be prevented that the amount of compressed gas dissolved in the contents is decreased.

There are mainly two methods for loading compressed gas into the double-chamber container. In a former method that is a so-called TN loading method, the contents (concentrate) are loaded into the inner cylinder, and a valve is crimped to the outer cylinder. Then, compressed gas to be dissolved into the contents is loaded into the inner cylinder from a stem of the valve. Thereafter, compressed gas for depressing the inner cylinder is loaded through a bottom plug of the outer cylinder.

In a latter method, a spray valve is first crimped to the outer cylinder in case of employing a double-chamber container provided with a check valve at a bottom portion of the inner cylinder permitting only flow of gas from the inner cylinder into the outer cylinder (while the flow of contents is not permitted). Then, compressed gas is loaded into the outer cylinder from a stem of the spray valve and the inner cylinder through the check valve. Thereafter, the compressed gas in the interior of the inner cylinder is purged to the exterior from the stem of the spray valve. Accompanying this process, the inner cylinder is in a deflated condition while on the other hand, the interior of the spatial portion of the outer cylinder maintains a condition in which compressed gas is loaded since the check valve is closed. Finally, the loading process is completed by sequentially loading contents (concentrate) and compressed gas to be dissolved into the contents from the spray valve into the interior of the inner cylinder.

However, in a conventional aerosol product employing a double-chamber container, it is required to load compressed gas for making the inner cylinder shrink in addition to compressed gas to be dissolved in the contents, whereby the manufacturing becomes troublesome.

Moreover, since compressed gas needs to be loaded into the spatial portion between the inner cylinder and the outer cylinder in addition to compressed gas to be dissolved in the contents to obtain a desired pressure for the product, it is presented a drawback that the loading amount of contents loaded into the inner cylinder with respect to the inner volume of the outer cylinder is only approximately 60% which is the same level as in the case of a single-walled can.

In the former TN loading method in which compressed gas is loaded into the inner sack through the stem, the space of the interior of the inner sack is smaller compared to the space of the outer cylinder so that the loading pressure at the time of loading a specified amount of compressed gas into the inner sack becomes high. This might result in a drawback that the inner sack would burst.

On the other hand, while TN loading might also be performed in the latter loading method, loading of the inner sack might be performed wherein the compressed gas to be dissolved into the contents (concentrate) is preliminarily dissolved and/or mixed into the contents. This, however, would require the provision of an exterior tank for dissolving and mixing purposes.

Further, in a conventional aerosol product employing a double-chamber container, it is often the case that the contents are in a non-foamed condition (that is, compressed gas (propellant) is not sufficiently dissolved into the contents (concentrate)) so that such products are unsuitable for contents containing a large amount of resin such as resin for hairdressing purposes which is apt to be choked at the stem.

The present invention has been made for the purpose of solving the above problems, and it is an object of the present invention to provide an aerosol product and a method for manufacturing the same wherein the pressure of the product can be made low and the product can be easily manufactured. It is another object of the present invention to provide an aerosol product wherein the loading amount of the contents can be increased compared to conventional products.

DISCLOSURE OF THE INVENTION

The aerosol product according to the present invention is an aerosol product comprising a double-chamber container separated by a movable partition capable of dividing contents therewith, one spatial portion thereof being loaded with contents to be discharged and the other spatial portion being loaded with compressed gas for pressurizing, characterized in that the compressed gas is a mixed compressed gas of at least two types of mixed gas, in that at least a part of the partition presents permeability of the compressed gas, and in that the mixed compressed gas selectively permeates the partition to be dissolved in the contents to be ready for discharge.

It is preferable that the compressed gas for pressurizing is a mixed gas including a compressed gas of which Ostwald coefficient is not less than 0.5 with respect to the contents at a temperature of 25° C. and a second compressed gas of which Ostwald coefficient is not more than 0.3.

It is preferable that the contents include water, monovalent alcohol or a mixed liquid thereof, that the first compressed gas is carbonic acid gas, and that the second compressed gas is nitrogen.

It is preferable that the partition is made of olefin group resin, especially of polyethylene or polypropylene.

It is preferable that the partition is a piston provided to be slidable between an inner surface of the exterior container, wherein a material for the piston is polyester, vinyl chloride resin, ABS resin or nylon.

The method for manufacturing an aerosol product according to the present invention is a method for manufacturing an aerosol product employing a double-chamber container separated by a movable partition of which at least a part presents gas permeability, and which is capable of separating contents therewith, characterized in that the method includes the steps of (a) loading contents to be discharged into one spatial portion of a double-chamber container interior, (b) loading a mixed compressed gas for pressurizing including at least two types of mixed gas into the other spatial portion of the double-chamber container interior, and (c) dissolving the mixed compressed gas into the contents after selectively making the gas permeate the partition.

It is preferable that the method for manufacturing an aerosol product employ, as the double-chamber container, an aerosol container in which a spray valve is fitted onto an outer cylinder accommodating therein a gas-permeable inner cylinder, and includes the steps of (a) loading the contents into the inner cylinder, (b) loading the mixed compressed gas into a spatial portion provided between the outer cylinder and the inner cylinder, and (c) dissolving the mixed compressed gas into the contents after selectively making the gas permeate the inner cylinder.

It is preferable that the method for manufacturing an aerosol product employ, as the double-chamber container, a piston-type aerosol container having a cylindrical exterior container, a piston provided in the exterior container to be slidable with respect to an inner surface of the exterior container, and an upper chamber and a lower chamber formed by being separated by the piston within the exterior container, wherein a spray valve is fitted onto an open end of the outer cylinder, and includes the steps of (a) loading contents into either of the upper chamber and lower chamber, (b) loading compressed gas into an interior of the other of the upper chamber and lower chamber, and (c) dissolving the mixed compressed gas into the contents after selectively making the gas permeate the piston.

In the aerosol product of the present invention, there is employed a gas-permeable partition as a partition (inner cylinder, piston) for separating the interior of the double-chamber into two spatial portions wherein one of the spatial portions is loaded with contents to be discharged, while the other one of the spatial portions is loaded with compressed gas for pressurizing and retained. In this manner, the mixed compressed gas is selectively made to permeate the partition to be dissolved into the contents so that manufacturing is made easy.

Further, since the aerosol product according to the present invention employs a double-chamber container provided with a partition such as an inner sack, the degree of pressure descent is smaller than compared those of aerosol products employing a conventional single type container with no inner sack, so that the pressure of the final product can be made low.

Also, since the compressed gas to be dissolved into the contents is mixed compressed gas kept in a spatial portion between the inner cylinder and the outer cylinder and is used in a selective manner, the compressed gas can be suitably selected to be, for instance, a mixed gas of a first compressed gas of which Ostwald coefficient with respect to the contents is not less than 0.5 at a temperature of 25° C. (e.g. carbonic acid gas) and a second compressed gas of which Ostwald coefficient is not more than 0.3 (e.g. nitrogen). With this arrangement, it is enabled to make the first compressed gas is mainly made to permeate the inner cylinder and is dissolved in the contents while the second compressed gas which is hardly soluble into the contents is mainly used for pressurizing the inner cylinder. In this case, only the first compressed gas (carbonic acid gas) is dissolved into the contents (while the second compressed gas (nitrogen) is included in the exterior of the inner cylinder) so that gas drifting that occurs after the spray can be made small and gas withdrawal of the first compressed gas at the time of spray can be prevented, whereby the pressure descent can be made small. In this manner, the loading amount for the contents can be secured to be approximately 70% of the inner volume of the outer cylinder.

BEST MODE FOR CARRYING OUT THE INVENTION

Figure 1:
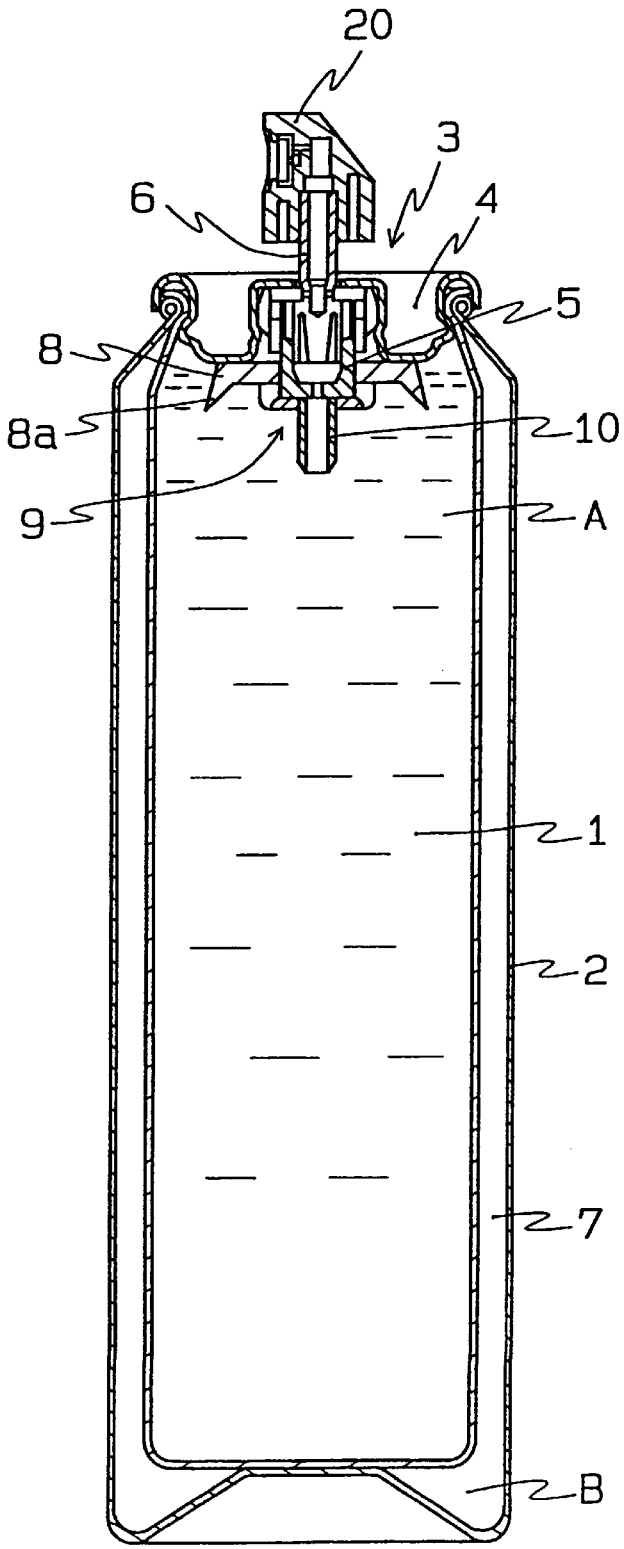
FIG. 1 is a sectional explanatory view showing one embodiment of an aerosol product according to the present invention.
Figure 2:
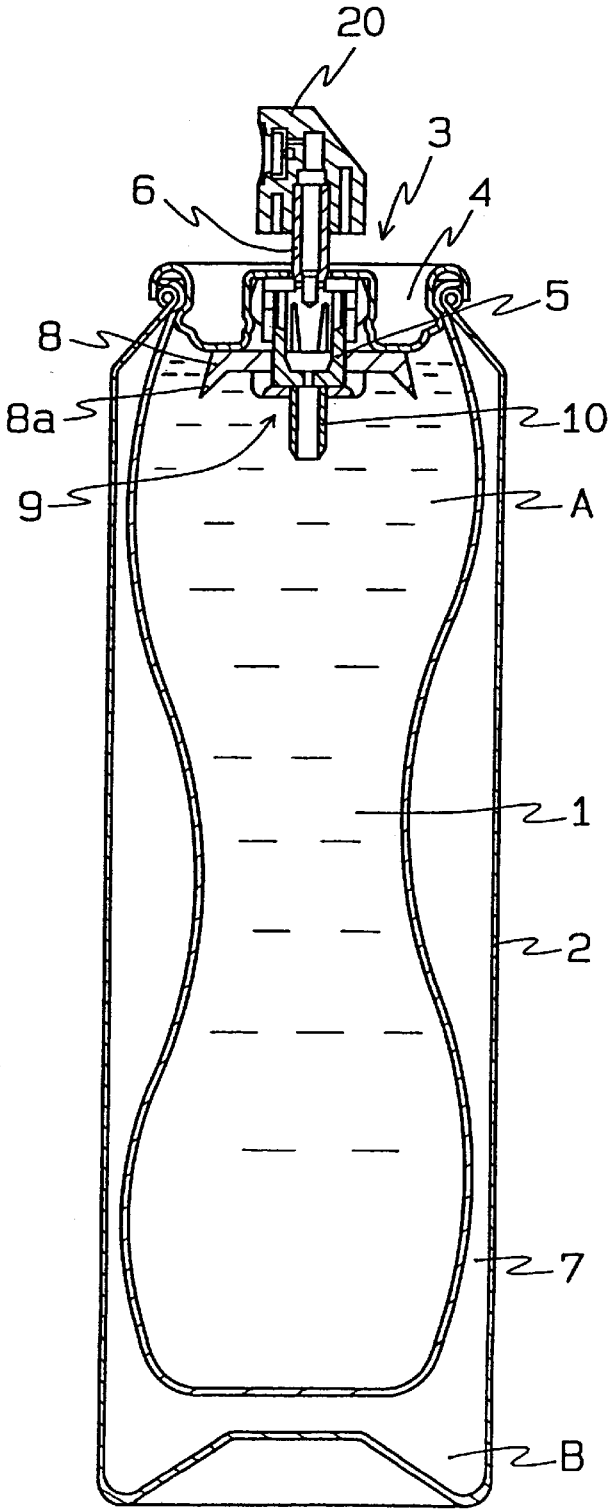
FIG. 2 is a sectional explanatory view showing a condition after spray of the aerosol product of FIG. 1.
Figure 3:
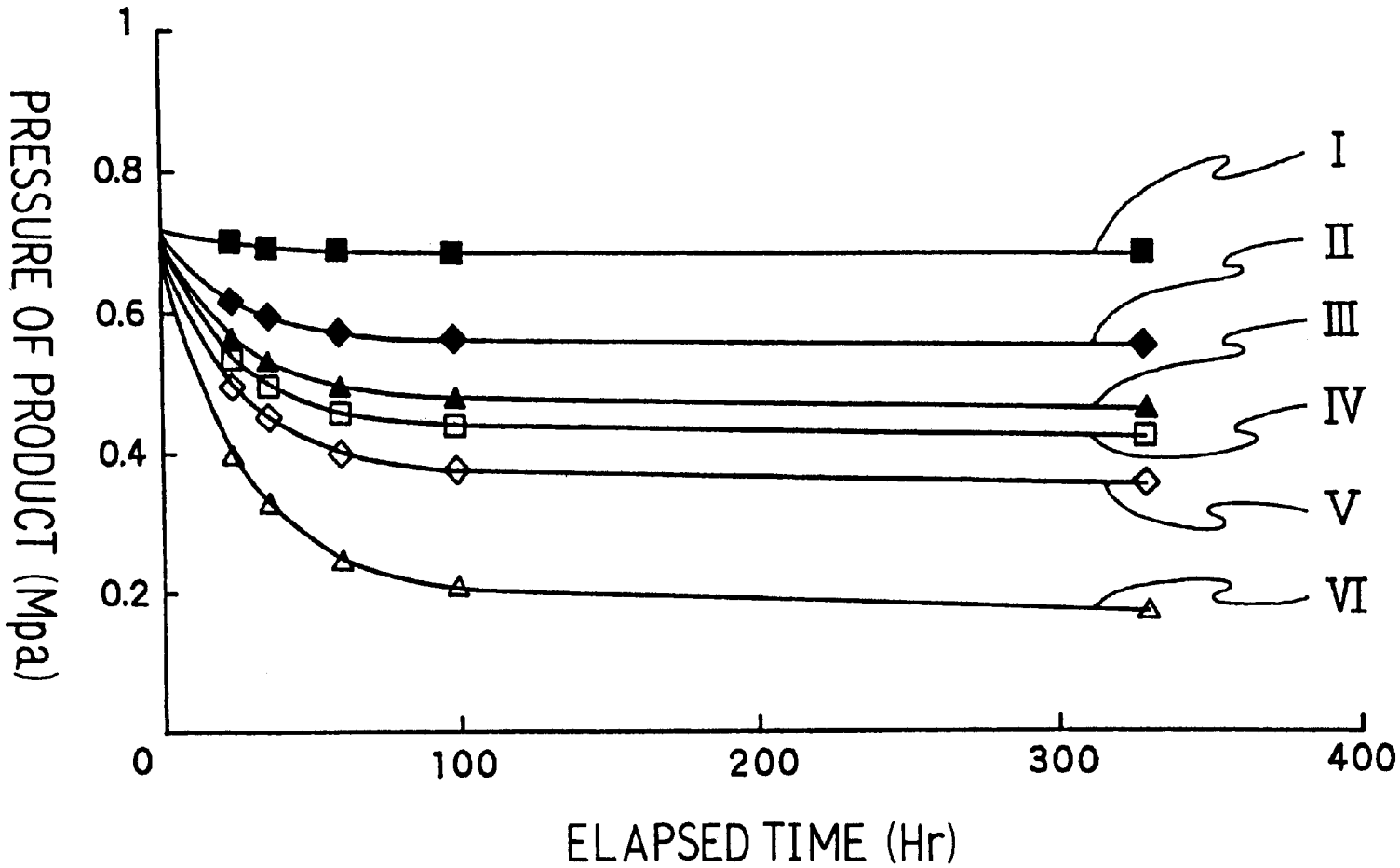
FIG. 3 is a graph showing pressure variations of mixed compressed gas in the interior of the spatial portion of the aerosol product of FIG. 1.
Figure 4:
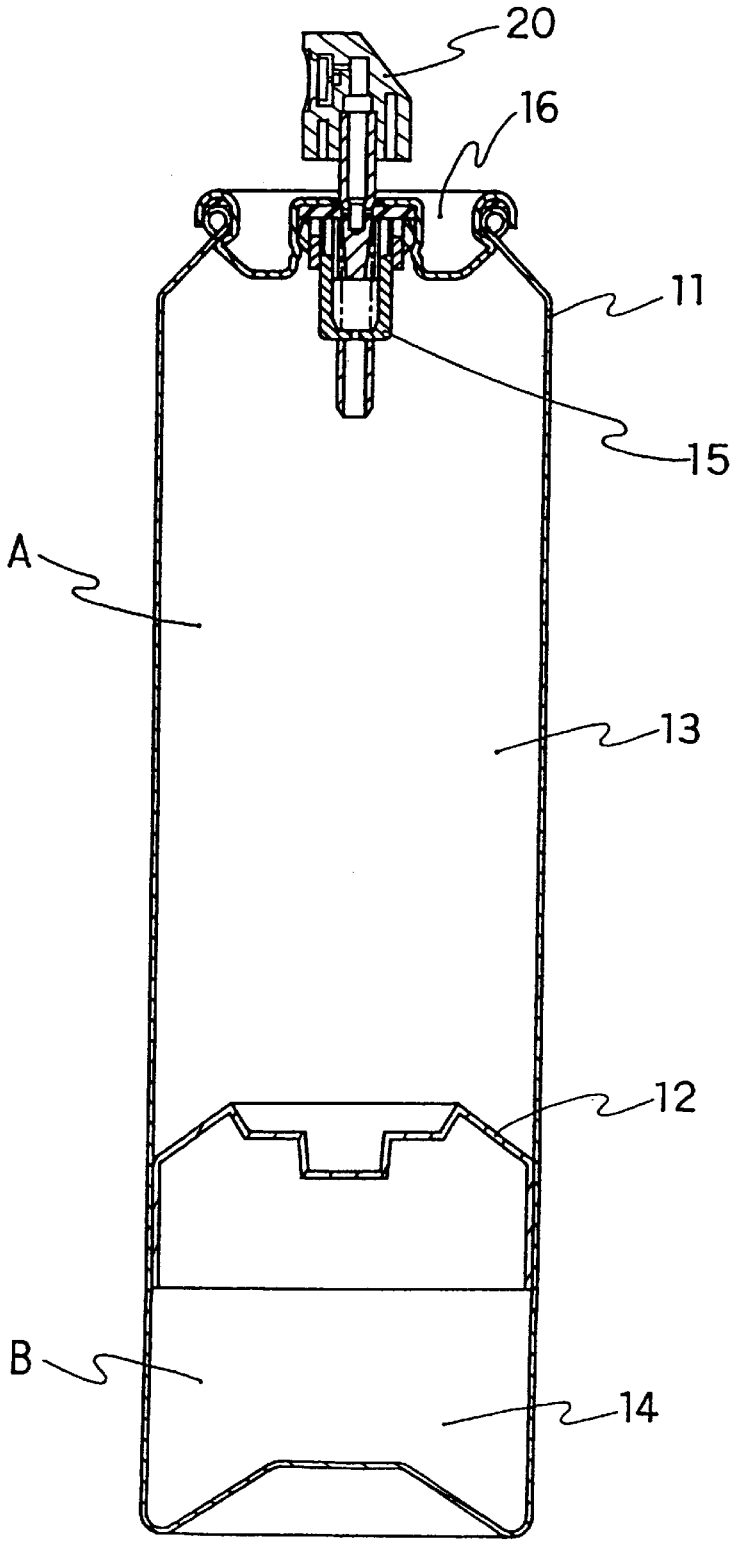
FIG. 4 is a sectional explanatory view showing another embodiment of the aerosol product according to the present invention.
Figure 5:
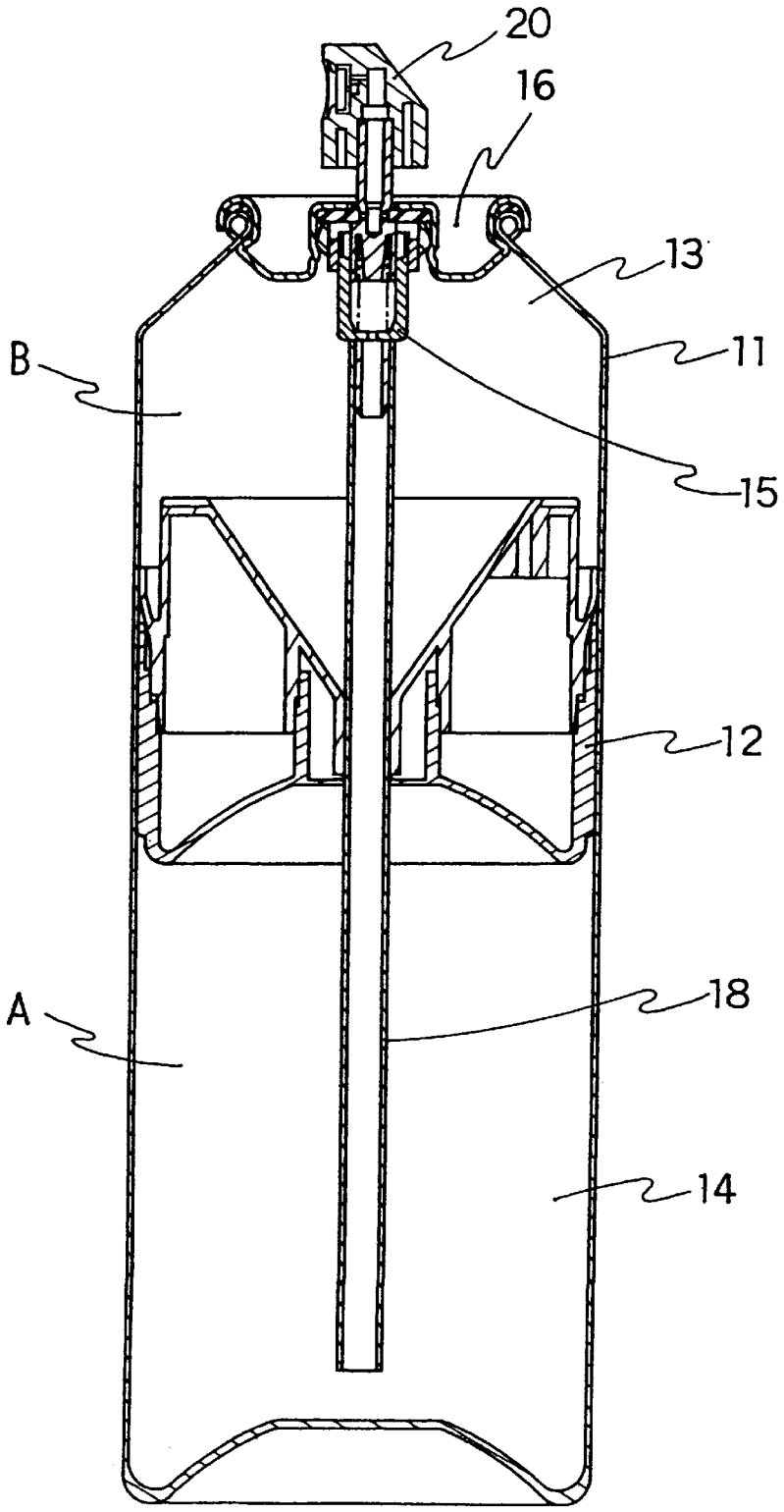
FIG. 5 is a sectional explanatory view showing still another embodiment of the aerosol product according to the present invention.
Figure 6:
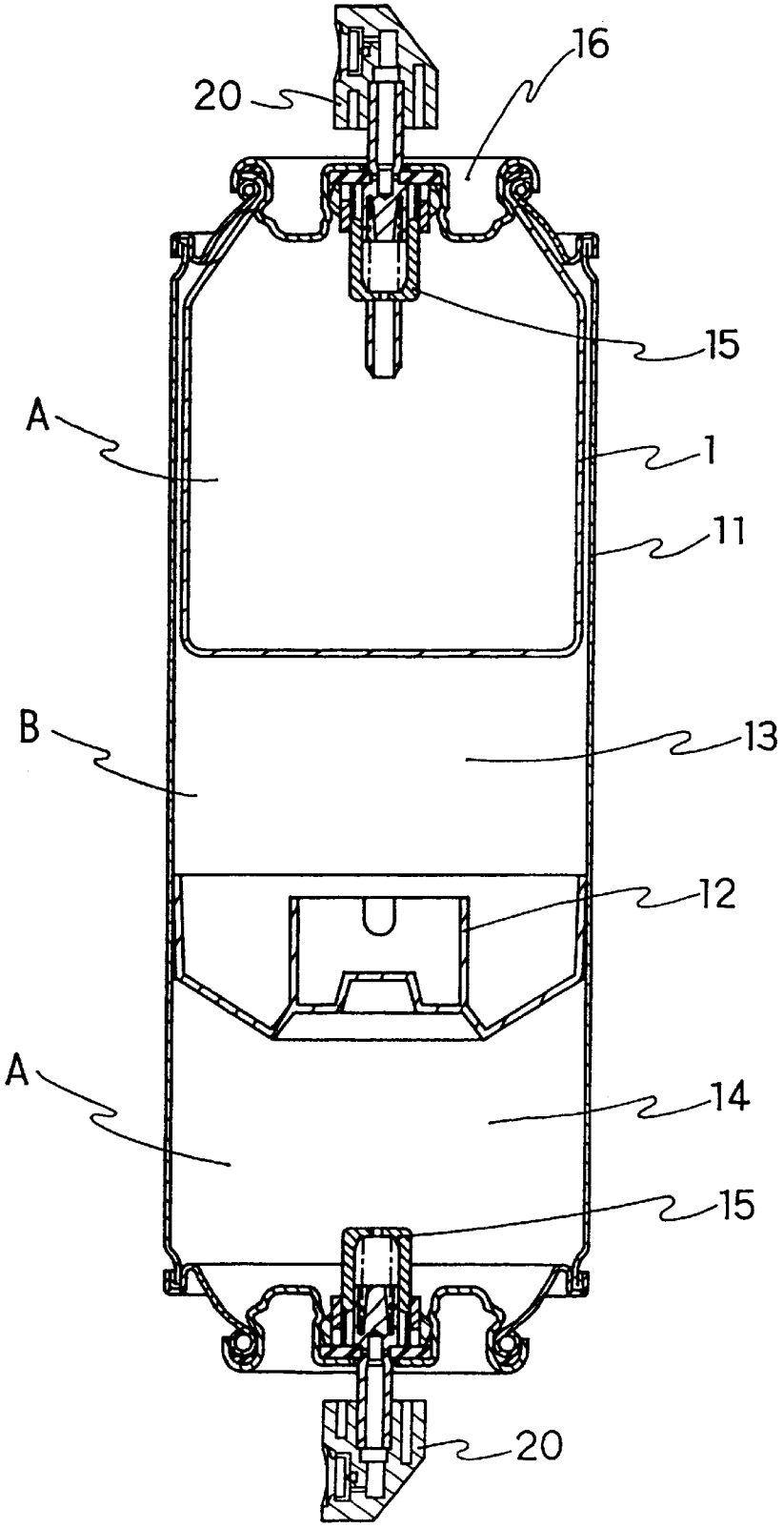
FIG. 6 is a sectional explanatory view showing yet another embodiment of the aerosol product according to the present invention.

The aerosol product according to the present invention will now be explained in details with reference to the drawings. FIG. 1 is a sectional explanatory view showing one embodiment of an aerosol product according to the present invention, FIG. 2 is a sectional explanatory view showing a condition after spray of the aerosol product of FIG. 1, FIG. 3 is a graph showing pressure variations of mixed compressed gas in the interior of the spatial portion of the aerosol product of FIG. 1, FIG. 4 is a sectional explanatory view showing another embodiment of the aerosol product according to the present invention, FIG. 5 is a sectional explanatory view showing still another embodiment of the aerosol product according to the present invention, and FIG. 6 is a sectional explanatory view showing still another embodiment of the aerosol product according to the present invention.

The aerosol container shown in FIG. 1 employs a flexible inner cylinder 1 as a partition, the container being a so-called double-chamber pressurizing container wherein contents A in an interior of the gas-permeable inner cylinder 1 is forced out by compressed gas B in an interior of a spatial portion 7 provided between the inner cylinder 1 and an outer cylinder 2. A mounting cup 4 for supporting a spray valve 3 is fitted in a sealing manner onto the outer cylinder 2 which accommodates therein the inner cylinder 1. A button 20 is fitted to a valve stem 6.

The aerosol container as shown in FIG. 1 is further provided with a gas ejecting tool 9 at a lower portion of a valve housing 5 which pierces through the inner cylinder 1 in case the contents A within the inner cylinder 1 is decreased to be less than a specified amount so that the compressed gas B in the spatial portion 7 can be reliably discharged to the exterior of the container through the valve stem 6 of the spray valve 3. The gas ejecting tool 9 includes, at a peripheral portion thereof, a triangular tip-sharpened extrusion 8 having a sharpened tip 8*a* and which is inclined towards an inner wall of the inner cylinder 1. A discharge conduit 10 is supported at a bottom portion of the tip-sharpened extrusion 8 for introducing the contents A into the spray valve 3.

The inner cylinder 1 is made of a material having gas-permeability and which is capable of dividing the contents (that is, which is substantially not permeable with respect to the contents). It is preferable that the inner cylinder 1 is made of olefin group resin that is superior in terms of resistivity with respect to chemicals such as acid or alkali and is also superior in terms of gas-permeability, wherein polypropylene (PP) or polyethylene (PE) is especially preferable in terms of low costs.

Compressed gas B is loaded into the interior of the spatial portion 7 and dissolved into contents A by permeating, in a selective manner, through the inner cylinder 1 which presents gas-permeability. Loading of the compressed gas B might be performed through conventionally known methods as used for single-walled cans. In one example, the following steps might be performed: contents A (concentrate) is loaded into the inner cylinder 1; the spray valve 3 is mounted onto the outer cylinder 2; thereafter, compressed gas which is mixed in a manner as will be explained later is loaded into the spatial portion 7 through a clearance between the inner cylinder 1 and the outer cylinder 2; and finally, the spray valve 3 (more particularly, the mounting cup 4) is crimped. This is an unprecedented simple loading method for a double-chamber container.

The compressed gas B is composed of at least one sort of gas for presenting two functions, that is, a first function of dissolving into the contents A for making the contents A be sprayed in a form of fine foggy particles or be discharged in a foamed condition and a second function of making the inner cylinder 1 shrink, and might be selected from among carbonic acid gas ($CO_2$), nitrogen ($N_2$), oxygen ($O_2$), nitrous oxide ($N_2O$) or air etc. which are also used in conventional methods. While air is generally a mixture a nitrogen and oxygen, air is not considered to be a mixed gas. When compared to liquefied gas such as the above-mentioned liquefied petroleum gas, the decrease in pressure at low temperature is smaller in case of using carbonic acid gas, nitrogen, oxygen, nitrous oxide or air. Therefore, pressure differences of the pressure of the inner cylinder interior and the pressure of the spatial portion 7 between the outer cylinder and the inner cylinder can be made small so that there is no fear that the inner cylinder 1 would burst.

Among these, it is preferable that the gas is a mixed gas of a first compressed gas having an Ostwald coefficient of not less than 0.5 with respect to the contents A at a temperature of 25° C. and a second compressed gas having an Ostwald coefficient of not more than 0.3. Using this mixed gas, the first compressed gas might be mainly made permeate the inner cylinder 1 and dissolved into contents A while the remaining gas which mainly includes the second compressed gas which is hardly soluble in the contents (which is compressed gas B in FIG. 1) is used for shrinking the inner cylinder A. At this time, the degree of pressure descent in the interior of the inner cylinder is smaller than compared to a case in which the compressed gas includes only the first compressed gas (for instance, in case only carbonic acid gas is used as in the example that will be explained later). With this arrangement, the loading amount for the contents can be secured to be approximately 70% of the inner volume of the outer cylinder.

The Ostwald coefficient of the first compressed gas should preferably be one presenting large solubility in order to present performance as a compressed gas or to act as a foaming agent and should preferably be not less than 0.5. On the other hand, the Ostwald coefficient of the second compressed gas should preferably be one presenting small solubility in order to act as a pressurizing agent and should preferably be not more than 0.3.

The mixing ratio of the first compressed gas and the second compressed gas should preferably be in the range of approximately 10–90:90–10 and further in the range of 20–80:80–20.

In case compressed gas having an Ostwald coefficient of not less than 0.5 is dissolved into the contents, the following three effects can be achieved.

(1) Minute foaming objects can be obtained.

Taking an example in which the compressed gas to be dissolved into contents including foaming components has an Ostwald coefficient of 2, 2 ml of compressed gas is dissolved per 1 ml of contents (concentrate) when the pressure is 0.1 MPa. Thus, in case the pressure is 0.3 MPa, approximately 6 ml is dissolved (that is, compressed gas corresponding to 5 to 10 times the volume of the concentrate is dissolved). Especially in case of LPG (liquefied petroleum gas), its foaming specific gravity (weight of foaming objects per unit volume) is 0.03 to 0.05. Thus, a foaming object having a volume that is 30 to 20 times the volume of the concentrate can be obtained. In a foaming object including dissolved compressed gas, gas within a liquid film is smaller than in a foaming object obtained with liquefied gas so that it contains therein quite a large amount of minute foams (minute foaming object).

Since such a minute foaming object can be obtained, contents remaining in the interior of the stem is also sufficiently foamed than compared to non-foamed objects so that its density is also very small. Thus, only a small amount of resin which is contained in the contents sticks to the path so that the path is not apt to be choked. Consequently, the double-chamber container can suitably used also for contents containing a large amount of resin which is apt to choking such as resin for hairdressing purposes.

(2) Minute particles can be obtained.

In case compressed gas having an Ostwald coefficient of not less than 0.5 is dissolved into contents which does not include foaming components, the compressed gas which has been dissolved by a large amount is rapidly discharged from the contents so that the contents to be sprayed can be sprayed in a form of minute particles.

(3) pH adjustments can be performed.

In case of employing carbonic acid gas as a compressed gas having an Ostwald coefficient of not less than 0.5, the dissolution of carbonic acid gas into the contents will result in a shift towards an acid condition so that pH of the contents might be desirably adjusted. Consequently, it can be presented for circulation promoting effects of the contents (reference should be made to Japanese Examined Patent Publication No. 47684/1988).

For particularly selecting the compressed gas B, the solubility of carbonic acid gas ($CO_2$), nitrogen ($N_2$), oxygen ($O_2$), nitrous oxide ($N_2O$) and air with respect to a solvent of water-ethyl alcohol group, which is conventionally used for general aerosol products, is tested. Table 1 shows values of solubility of each of the gases with respect to water at a temperature of 25° C. and values of solubility with respect to ethyl alcohol (it should be noted that the Ostwald coefficient of air with respect to ethyl alcohol is an actually measured value).

TABLE 1

| | $CO_2$ | $N_2$ | $O_2$ | $N_2O$ | Air |
|---|---|---|---|---|---|
| Water | 0.759 | 0.0143 | 0.0283 | 0.575 | 0.0167 |
| Ethyl Alcohol | 2.94 | 0.143 | 0.220 | 2.09 | 0.158 |

It can be understood from Table 1 that the first compressed gas having an Ostwald coefficient of not less than 0.5 at a temperature of 25° C. includes carbonic acid gas and nitrous oxide, while the second compressed gas of which Ostwald coefficient is not more than 0.3 includes nitrogen, oxygen and air. Among these, especially a mixed gas of carbonic acid gas and nitrogen is most preferable in view of stability (of container, contents etc.) of the aerosol product.

As a reference, values of critical temperature for each of the carbonic acid gas, nitrogen, oxygen, nitrous oxide, and air are shown in Table 2. It should be noted that a critical temperature is a temperature at which no liquefaction is enabled upon applying a high pressure but merely a highly densified gas is generated.

TABLE 2

| | Critical Temperature (° C.) |
|---|---|
| $CO_2$ | 31.1 |
| $N_2$ | −147.0 |
| $O_2$ | −118.4 |
| $N_2O$ | 36.5 |
| Air | −140.7 |

It can be understood from Table 2 that there exists a correlation between the Ostwald coefficient and the critical temperature. Thus, upon comparing Tables 1 and 2, the first compressed gas might be defined to be a gas having a critical temperature which is in the range of 0 to 50° C. and the second compressed gas might be defined to be a gas having a critical temperature which is not more than −100° C.

For manufacturing an aerosol product as shown in FIG. 1, the contents A is first loaded into the gas-permeable inner cylinder 1 of FIG. 1, and a mixed compressed gas B is then loaded into the spatial portion 7 between the outer cylinder 2 and the inner cylinder 1 and is retained thereafter. By retaining it for a specified time, the mixed compressed gas B can be selectively made permeate the inner cylinder 1 to be dissolved into the contents A so that easy manufacturing is enabled. Moreover, since there is no need to load compressed gas into an inner sack (which corresponds to the inner cylinder 1 of the present embodiment) by applying a large loading pressure as it was necessary in prior art loading methods, there is no fear that the inner sack is burst. Further, there is no need to provide for a tank for dissolving and mixing purposes.

Since the aerosol product of FIG. 1 employs a double-chamber container having an inner cylinder 1, the danger of misuse is eliminated than compared to conventional aerosol products employing a single-walled can which is not provided with an inner cylinder, while the degree of pressure descent is small so that the internal pressure of the final product can be made low. For instance, compared to a pressure of approximately 0.2 MPa in a final product employing a single-walled can, a desired condition for spray can be maintained for a product of double-chamber type as shown in FIG. 1 when the internal pressure of the final product is not less than 0.07 MPa, and preferably, not less than 0.1 MPa.

In case the compressed gas B includes only carbonic acid gas of which solubility is relatively large, the gas is well dissolved into the contents A and foamed portions thereof are ejected at the time of spray so that the degree of pressure descent after the spray is large. Hence, it is necessary to set the initial pressure somewhat higher in view of the final condition of spray (approximately 0.15 MPa which is still by far smaller than the pressure of 0.2 MPa of a final product employing a single-walled can). Moreover, in case the pressure is decreased accompanying the deflating of the inner cylinder after spray as shown in FIG. 2, carbonic acid gas that has dissolved into the contents A acts to recover the original shape so that a gas drift is generated at an upper portion of the inner cylinder 1, thereby only gas is sprayed without being accompanied by the contents A at the time of performing the following spray (so-called gas withdrawal occurs), resulting in a loss of gas.

Therefore, by employing the above-described mixed gas including a first compressed gas such as carbonic acid gas and a second compressed gas such as nitrogen, almost all of the nitrogen will remain at the spatial portion 7 at the exterior of the inner cylinder 1 so that the degree of pressure descent after spray can be made small and gas drifts are hardly generated. Thus, it can be presented for an effect that the initial pressure can be set low and hardly any loss of gas is caused.

In one embodiment, 100 g of refined water was loaded into an inner sack made of gas-permeable resin and the mixed compressed gases shown in Table 3 were respectively loaded into a spatial portion between a metallic container and the inner sack. Pressure variations of the mixed compressed gases in the interior of the spatial portion were measured immediately after the loading and at respective elapsed times.

As can be understood from Table 3 and the graph of FIG. 3 corresponding to Nos. I–VI of Table 3, while both compressed gases permeate the inner cylinder (the particle size of nitrogen gas being smaller than that of carbonic acid gas), differences in the Ostwald coefficient resulted in a selective dissolution of $CO_2$.

TABLE 3

| No. | Kind of Mixed Compressed Gas (% by weight) | Immediately After Loading (Mpa) | 1 Hour Later | 2 Hours Later | 3 Hours Later | 5 Hours Later | 8 Hours Later | 24 Hours Later | 36 Hours Later | 60 Hours Later | 100 Hours Later | 330 Hours Later |
|---|---|---|---|---|---|---|---|---|---|---|---|---|
| I | $N_2/CO_2$ = 100/0 | 0.719 | 0.719 | 0.717 | 0.717 | 0.713 | 0.708 | 0.700 | 0.694 | 0.690 | 0.685 | 0.677 |
| II | $N_2/CO_2$ = 80/20 | 0.709 | 0.706 | 0.700 | 0.691 | 0.682 | 0.665 | 0.617 | 0.594 | 0.572 | 0.563 | 0.549 |
| III | $N_2/CO_2$ = 60/40 | 0.708 | 0.703 | 0.694 | 0.681 | 0.665 | 0.642 | 0.565 | 0.532 | 0.496 | 0.479 | 0.458 |
| IV | $N_2/CO_2$ = 40/60 | 0.702 | 0.697 | 0.685 | 0.673 | 0.655 | 0.628 | 0.535 | 0.497 | 0.459 | 0.441 | 0.420 |
| V | $N_2/CO_2$ = 20/80 | 0.703 | 0.696 | 0.683 | 0.666 | 0.644 | 0.611 | 0.495 | 0.451 | 0.400 | 0.377 | 0.352 |
| VI | $N_2/CO_2$ = 0/100 | 0.698 | 0.682 | 0.665 | 0.641 | 0.611 | 0.563 | 0.396 | 0.331 | 0.249 | 0.210 | 0.172 |

Next, an aerosol product employing a piston as a partition will be explained.

The aerosol product shown in FIG. 4 comprises a cylindrical exterior container 11 and a gas-permeable piston 12 which is provided to be slidable between an inner surface of the exterior container 11, and which is capable of dividing contents (that is, which is substantially not permeable of the contents). Within the exterior container 11, there are formed an upper chamber 13 and a lower chamber 14 by being separated by the piston 12. A mounting cup 16 for supporting a spray valve 15 is fitted in a sealing manner onto an open end at an upper portion of the exterior container 11. Note that reference numeral 20 denotes a button.

The contents A to be discharged is loaded into the upper chamber 13 while the compressed gas B is loaded into the lower chamber 14. The mixed compressed gas B in the lower chamber 14 is dissolved into contents A by permeating, in a selective manner, the gas-permeable piston 12.

A gas-permeable resin used for the piston 12 is not especially limited so long as it presents superior gas-permeability and pressure resistance in addition to slidability. Representative examples of such gas-permeable resin are, for instance, polyethylene, polypropylene, polyester, vinyl chloride resin, ABS resin or polyamide represented by nylon. Such gas-permeable resin might be used either in a single state or as a laminated body.

The piston 12 might either be a molded article formed through blow molding method, or alternatively, a molded article formed through injection molding method. Further, while the configuration of the piston 12 is not especially limited, a representative configuration thereof is cylindrical. Although the thickness for the piston 12 cannot be explicitly determined since it is varied by the sort of gas-permeable resin which composes the piston 12, it is preferable that the thickness is in the range of approximately 0.5 to 2 mm to ensure sufficient pressure resistance and gas-permeability.

For manufacturing the aerosol product shown in FIG. 4, mixed compressed gas is first loaded into an upper chamber 13 and lower chamber 14. By simply performing loading of mixed compressed gas into the upper chamber, the gas can be also loaded into the lower chamber 13 since a lateral side of the piston 12 (a portion at which it contacts an inner surface of exterior container 11) is bent at the time of performing gas loading. After purging mixed compressed gas in the interior of the upper chamber 13, contents A is loaded into the upper chamber 13. After retaining it for a specified time, a part of the compressed gas B is made to permeate the piston 12 to be dissolved in the contents A so that easy manufacturing is enabled. Moreover, since it is not necessary to load compressed gas by applying a large loading pressure, there is no fear that the piston is damaged, and it is also not necessary to provide for a tank for dissolving and mixing purposes.

It should be noted that while FIG. 4 shows an example in which contents A are loaded into the upper chamber 13 and compressed gas B into the lower chamber 13, the present invention is not limited to this. For instance, in an alternative example of an aerosol product employing a piston as a partition shown in FIG. 5, contents A are loaded into lower chamber 14 and compressed gas B into upper chamber 13, wherein the lower chamber 14 is connected to a spray valve 15 through a tube 18 piercing through the gas-permeable piston 12 with which similar effects as the above-described effects might be obtained. Note that reference numeral 20 denotes a button.

Further, similar effects might also be achieved with an aerosol product shown in FIG. 6 wherein both of the above-described gas-permeable inner cylinder 1 and the piston 12 are employed as a partition. It should be noted that in the case shown in FIG. 6, contents A are loaded into the inner cylinder 1 and the lower chamber 14 while compressed gas B is loaded into the upper chamber 13. Note that reference numeral 20 denotes a button.

The above-described aerosol product of double-chamber type including a gas-permeable partition might be applied for cleaning agents (see Japanese Unexamined Patent Publication No. 243900/1986), Cologne water for the body (see Japanese Unexamined Patent Publication No. 141910/1988), hair restoration agents (see Japanese Unexamined Patent Publication No. 141917/1988), antipruritic agents (see Japanese Unexamined Patent Publication No. 141918/1988), patches of external preparation (see Japanese Unexamined Patent Publication No. 230514/1989), adhesives (see Japanese Unexamined Patent Publication No. 9971/1991), antiperspiration agents (see Japanese Unexamined Patent Publication No. 148212/1991), hot foams (see Japanese Unexamined Patent Publication No. 264186/1992), antiphlogistic analgesic (see Japanese Unexamined Patent Publication No. 279250/1993), oral agents (see Japanese Unexamined Patent Publication No. 345026/1993), toothpaste (see Japanese Unexamined Patent Publication No. 55659/1994, No. 42218/1995), sterilizing disinfectants (see Japanese Unexamined Patent Publication No. 327750/1994), hair-care articles (see Japanese Unexamined Patent Publication No. 206648/1995), and skin-care articles (see Japanese Unexamined Patent Publication No. 330540/1995).

The aerosol product according to the present invention employs a gas-permeable partition for a double-chamber container, whereby mixed compressed gas can be selectively made to permeate the partition to be dissolved into contents so that the manufacturing thereof is made easy. Moreover, since it is not required to perform loading of compressed gas by applying a large loading pressure, there is no fear that the partition is damaged. There is also no necessity to provide for a tank for dissolving and mixing purposes.

Employing a double-chamber container, it is enabled to provide an aerosol product of which pressure of the final product is made low compared to conventional aerosol products which are not equipped with an inner sack.

In case of utilizing a mixed gas including a first compressed gas of which Ostwald coefficient with respect to the contents is not less than 0.5 at a temperature of 25° C. and a second compressed gas which Ostwald coefficient is not more than 0.3 as the compressed gas, the degree of pressure descent of the interior of a spatial portion accommodating therein the contents is made small whereby it is achieved to secure a loading amount for the contents that is larger than those of conventional products.

INDUSTRIAL APPLICABILITY

The aerosol product according to the present invention employs a gas-permeable partition for a double-chamber container, whereby mixed compressed gas can be selectively made to permeate the partition to be dissolved into contents so that the manufacturing thereof is made easy. Moreover, since it is not required to perform loading of compressed gas by applying a large loading pressure, there is no fear that the partition is damaged. There is also no necessity to provide for a tank for dissolving and mixing purposes so that it is useful as an aerosol product using a double-chamber type container.

What is claimed is:

1. An aerosol product comprising a double-chamber container separated by a movable partition capable of dividing contents therewith, one spatial portion thereof being loaded with contents to be discharged and the other spatial portion being loaded with compressed gas for pressurizing, wherein the compressed gas is a mixed compressed gas of at least two types of mixed gas, at least a part of the partition presents permeability of the compressed gas, the mixed compressed gas selectively permeates the partition to be dissolved in the contents to be ready for discharge, and the compressed gas for pressurizing is a mixed gas including a compressed gas of which Ostwald coefficient is not less than 0.5 with respect to the contents at a temperature of 25° C. and a second compressed gas of which Ostwald coefficient is not more than 0.3.

2. The aerosol product of claim 1, wherein the contents include water, monovalent alcohol or a mixed liquid thereof, the first compressed gas is carbonic acid gas, and the second compressed gas is nitrogen.

3. The aerosol product of any one of claims 1 or 2, wherein the partition is made of olefin group resin.

4. The aerosol product of claim 3, wherein the partition is made of one of polyethylene and polypropylene.

5. The aerosol product of any one of claims 1 or 2, wherein the partition is a piston provided to be slidable between an inner surface of the exterior container, wherein a material for the piston is polyester, vinyl chloride resin, ABS resin or nylon.

6. A method for manufacturing an aerosol product employing a double-chamber container separated by a movable partition of which at least a part presents gas permeability, and which is capable of separating contents therewith, the method including the steps of (a) loading contents to be discharged into one spatial portion of a double-chamber container interior, (b) loading a mixed compressed gas for pressurizing at least two types of mixed gases into the other spatial portion of the double-chamber container interior, and (c) dissolving the mixed compressed gas into the contents after selectively making the gas permeate the partition, and in that the compressed gas for pressuring is a mixed gas including a compressed gas of which Ostwald coefficient is not less than 0.5 with respect to the contents at a temperature of 25° C. and a second compressed gas of which Ostwald coefficient is not more than 0.3.

7. The method of claim 6, wherein the method for manufacturing an aerosol product employs, as the double-chamber container, an aerosol container in which a spray valve is fitted onto an outer cylinder accommodating therein a gas-permeable inner cylinder, and includes the steps of (a) loading the contents into the inner cylinder, (b) loading the mixed compressed gas into a spatial portion provided between the outer cylinder and the inner cylinder, and (c) dissolving the mixed compressed gas into the contents after selectively making the gas permeate the inner cylinder.

8. The method of claim 6, wherein the method for manufacturing an aerosol product employs, as the double-chamber container, a piston-type aerosol container having a cylindrical exterior container, a piston provided in the exterior container to be slidable with respect to an inner surface of the exterior container, and an upper chamber and a lower chamber formed by being separated by the piston within the exterior container, wherein a spray valve is fitted onto an open end of the outer cylinder, and includes the steps of (a) loading contents into either of the upper chamber and lower chamber, (b) loading compressed gas into an interior of the other of the upper chamber and lower chamber, and (c) dissolving the mixed compressed gas into the contents after selectively making the gas permeate the piston.

* * * * *